US007111445B2

(12) United States Patent
Threlkeld et al.

(10) Patent No.: US 7,111,445 B2
(45) Date of Patent: Sep. 26, 2006

(54) FIRE-RESISTANT SEWING YARN AND THE PRODUCTS MADE THEREFROM

(76) Inventors: James Threlkeld, 1007 Cranston Crossing Pl., Indian Train, NC (US) 28079; Nathaniel H. Kolmes, 1740 Fifth St. Dr. N.W., Hickory, NC (US) 28601

( * ) Notice: Subject to any disclaimer, the term of this patent is extended or adjusted under 35 U.S.C. 154(b) by 169 days.

(21) Appl. No.: 10/928,122

(22) Filed: Aug. 30, 2004

(65) Prior Publication Data

US 2006/0048495 A1 Mar. 9, 2006

(51) Int. Cl.
*D02G 3/02* (2006.01)

(52) U.S. Cl. ..... 57/229; 57/230

(58) Field of Classification Search ..... 57/210, 57/225, 229–232

See application file for complete search history.

(56) References Cited

U.S. PATENT DOCUMENTS

| | | | | |
|---|---|---|---|---|
| 4,777,789 | A | 10/1988 | Kolmes et al. | |
| 4,838,017 | A | 6/1989 | Kolmes et al. | |
| 4,936,085 | A | 6/1990 | Kolmes et al. | |
| 5,177,948 | A | 1/1993 | Kolmes et al. | |
| 5,382,264 | A | 1/1995 | Sharma | |
| 5,423,168 | A | 6/1995 | Kolmes et al. | |
| 5,628,172 | A | 5/1997 | Kolmes et al. | |
| 5,632,137 | A | 5/1997 | Kolmes et al. | |
| 5,644,907 | A | 7/1997 | Kolmes et al. | |
| 5,655,358 | A | 8/1997 | Kolmes | |
| 5,845,476 | A | 12/1998 | Kolmes | |
| 6,212,914 | B1 | 4/2001 | Kolmes et al. | |
| 6,230,524 | B1 | 5/2001 | Kolmes et al. | |
| 6,341,483 | B1 | 1/2002 | Kolmes et al. | |
| 6,349,531 | B1 | 2/2002 | Kolmes et al. | |
| 6,351,932 | B1 * | 3/2002 | Hummel | 57/210 |
| 6,363,703 | B1 | 4/2002 | Kolmes et al. | |
| 6,367,290 | B1 | 4/2002 | Kolmes et al. | |
| 6,381,940 | B1 | 5/2002 | Kolmes et al. | |
| 6,460,321 | B1 * | 10/2002 | Koshimae et al. | 57/210 |
| 6,467,251 | B1 | 10/2002 | Kolmes | |
| RE38,136 | E | 6/2003 | Kolmes | |

* cited by examiner

*Primary Examiner*—Shaun R. Hurley
(74) *Attorney, Agent, or Firm*—Oblon, Spivak, McClelland, Maier Neustadt, P.C.

(57) ABSTRACT

A composite heat resistant sewing thread comprising a core form of at least one strand of a yarn having an elongation, at least one bottom cover wrapped around the core in a first direction at a rate sufficient to provide substantially complete coverage of the core, at least one outer cover wrapped around the at least one bottom cover, at least one bonding agent, and a lubricant.

52 Claims, 2 Drawing Sheets

FIRE-RESISTANT SEWING YARN AND THE PRODUCTS MADE THEREFROM

BACKGROUND OF THE INVENTION

1. Field of Invention

The present invention relates to the area of fire resistant yarns and products made therefrom, particularly in the area of fire resistant sewing threads.

2. Discussion of the Background

A demand has developed for sewing thread that is heat and fire resistant. Such thread is used in sewing together the cover fabric for pillows, mattresses, bedding, and quilts for institutional use, as well as for sewing together the fabric used in safety apparel.

Sewing thread, because of the nature of its use, must be able to withstand the stresses created thereon by the many repeated bends and jerks occurring during the conventional sewing operation. Therefore it must be able to elongate without breaking.

Conventional sewing threads are made of cotton, nylon, or polyester. Each of these will either burn or melt in the presence of flame or high heat. Such fibers as aramids (KEVLAR®, CONEX®, and NOMEX®) are known to be heat resistant, but they are relatively inelastic and do not elongate. When used alone, threads made from these fibers do not provide as high a level of sewing performance as that provided by threads made from conventional fibers. These and other high performance fibers are also very expensive. Thus the use of such fibers has generally been limited to yarns for knitting and weaving.

Fiberglass is known to have excellent fire resistant capabilities, but problems exist with weaving or knitting it by itself. Therefore it only exists when blended, entangled or twisted with other fibers or filaments.

There still exists a need for a sewing thread that, in addition to functioning as a sewing thread, will withstand the high temperatures (greater than 1,000 degrees centigrade) of a fire. In such a case the sewing thread must maintain its integrity in the presence of high temperatures and flames to keep the seams of mattresses, pillows, and similar products intact, so that more flammable materials inside are not exposed to the flames. In the case of apparel the seams must remain intact to protect the worker.

SUMMARY OF THE INVENTION

Accordingly, one object of the present invention is to provide a heat resistant composite sewing thread that enables the production of heat and fire resistant articles such as mattresses, pillows, apparel items, etc. that will remain intact under intense heat (greater than 1000° C.).

A further object of the present invention is to provide a heat and fire resistant mattress made using the heat resistant sewing thread of the present invention.

A further object of the present invention is to provide a heat and fire resistant pillow made using the heat resistant sewing thread of the present invention.

A further object of the present invention is to provide an item of apparel made using the heat resistant sewing thread of the present invention.

These and other objects of the present invention have been satisfied, either individually or in combination, by the discovery of a composite heat resistant sewing thread comprising:

a) a core formed of at least one strand of a yarn having an elongation of at least 3%;

b) at least one bottom cover wrapped around the core in a first direction at a rate sufficient to provide substantially complete coverage of the core by the bottom cover, wherein the bottom cover has an elongation of less than 1% and is made of a high-tenacity yarn;

c) at least one outer cover wrapped around the at least one bottom cover, wherein the outer cover is wrapped in a second direction opposite to a direction of a cover layer on which the outer cover is directly wrapped, at a rate sufficient to provide substantially complete cover of the cover layer on which the outer cover is directly wrapped; and d) at least one bonding agent; and e) a lubricant;

wherein the composite heat resistant sewing thread remains intact when subjected to temperatures exceeding 1,000° C., and its use in the production of heat and/or fire resistant items, such as mattresses, pillows, apparel items, etc.

DETAILED DESCRIPTION OF THE INVENTION

Figure 1:
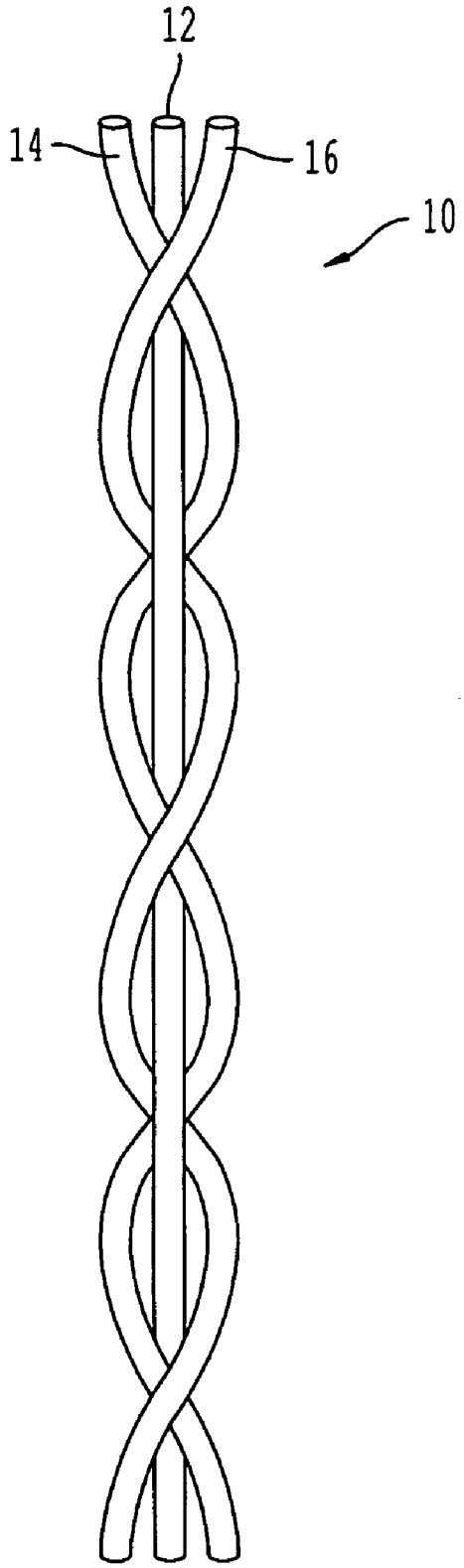
FIG. 1 is an enlarged schematic view of a representative portion of the sewing thread of the invention.

The present invention relates to a fire resistant composite yarn comprising a central core having one or more strands of a yarn having elongation of at least 3%, as measured in accordance with ASTM D-204, a bottom cover of one or more strands of a very high tenacity yarn having minimal or no elongation, such as fiberglass or aramid fibers, and an outer cover of a synthetic fiber, such as polyester or nylon strand(s)., treated with a suitable bonding agent, and with an outer application of a suitable lubricant. The fire resistant composite yarn is particularly suitable for use as a sewing thread.

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

As used herein, the term "high performance fiber" means that class of synthetic or natural non-glass fibers having high values of tenacity greater than 10 g/denier, such that they lend themselves for applications where high abrasion and/or cut resistance is important. Typically, high performance fibers have a very high degree of molecular orientation and crystallinity in the final fiber structure.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consist of a single strand.

The term "air interlacing" as used herein refers to subjecting multiple strands of yarn to an air jet to combine the strands and thus form a single, intermittently commingled strand. This treatment is sometimes referred to as "air tacking." This term is not used to refer to the process of "intermingling" or "entangling" which is understood in the art to refer to a method of air compacting a multifilament yarn to facilitate its further processing, particularly in weaving processes. A yarn strand that has been intermingled typically is not combined with another yarn. Rather, the individual multifilament strands are entangled with each other within the confines of the single strand. This air compacting is used as a substitute for yarn sizing and as a means to provide improved pick resistance. This term also does not refer to well known air texturizing performed to increase the bulk of single yarn or multiple yarn strands. Methods of air interlacing in composite yarns and suitable apparatus therefore are described in U.S. Pat. Nos. 6,349,531; 6,341,483; and 6,212,914, the contents of which are hereby incorporated by reference.

The term "composite yarn" refers to a yarn prepared from two or more yarns, which can be the same or different. Composite yarn can occur in a variety of forms wherein the two or more yarns are in differing orientations relative to one another. The two or more yarns can, for example, be parallel, wrapped one around the other(s), twisted together, or combinations of any or all of these, as well as other orientations, depending on the properties of the composite yarn desired. Examples of such composite yarns are provided in U.S. Pat. Nos. 4,777,789; 5,177,948; 5,628,172; 5,845,476; 6,351,932; 6,363,703 and 6,367,290, the contents of which are hereby incorporated by reference.

In the present invention fire resistant composite yarn, the elongation of the core of at least 3%, preferably 8%, more preferably 12%, is important to withstand sudden starts and stops realized in sewing. Suitable fibers for the core include any fiber having the desired elongation properties, preferably at least one member selected from the group consisting of cotton, polyurethane, polyester and nylon, most preferably at least one of polyester or nylon. (Within the context of the present invention, unless otherwise denoted, the terms "polyester" and "nylon" are used generically and include any of the conventional members of the polyester and nylon families of fibers, respectively. Nylon is preferably nylon-6,6. Polyester is preferably polyethylene terephthalate, polypropylene terephthalate or polybutylene terephthalate.) This core provides the elongation necessary for a sewing thread. The core may be of any desired denier, depending on the unit weight sewing thread desired. Preferably, the core has a denier of from 50 to 1500, more preferably from 200 to 900.

The bottom cover high tenacity yarn preferably has an elongation of less than 1%, more preferably no elongation. Suitable fibers for making up the bottom cover high tenacity yarn include any of the high tenacity yarns having the very low or non-existent elongation, preferably at least one member selected from the group consisting of fiberglass, aramids, and ceramic fibers, most preferably fiberglass. Since this bottom cover is helically applied, when subject to the bending stresses generated in the sewing operation, the helical configuration will allow some elongation of the bottom cover to prevent damage or breakage, particularly in the most preferred fiberglass case. Then if the sewn product is present in a fire, the bottom cover will remain intact and maintain the fabric sections together, even though the core may melt. The bottom cover is wrapped around the core at a rate of turns per inch sufficient to provide coverage of the core, and varies depending on the denier and diameter of the core, as well as the denier of the yarn making up the bottom cover. Preferably, the bottom cover is wrapped at a rate of from 4 to 15 tpi, more preferably from 6 to 12 tpi. The bottom cover yarn may have any desired denier, again depending on the desired size of the final product yarn. Preferably, the bottom cover has a denier from 50 to 1500, most preferably from 100 to 1000.

The outer cover may be made of any desired fiber, including both natural and synthetic fibers, and is preferably a synthetic fiber including, but not limited to, polyester or nylon. Like the bottom cover, the outer cover may be any desired denier, depending on the final size of the resulting yarn product and is preferably from 50 to 1500 denier, most preferably from 100 to 1000 denier. The outer cover is then wrapped at a rate sufficient to provide complete coverage of the bottom cover, preferably from 4 to 15 tpi, more preferably from 6 to 12 tpi, again depending upon the composite denier of the core/bottom cover combination and the denier of the yarn making up the outer cover. The outer cover preferably keeps the glass fibers contained within the thread, as well as protecting the core and bottom wrap.

The resulting composite yarn can have any desired composite denier, and preferably has a composite denier of from 300 to 1000, more preferably from 350 to 750.

The composite yarn is lubricated in a final operation so that the sewing thread can withstand the heat of the needle as it repeatedly slides through the needle eye during the sewing operation.

The invention further envisions products such as mattresses, pillows, quilts, and the like which are used in institutions, and which are covered with a fire resistant fabric sewn together by the fire resistant yarns of the present invention. Further, safety apparel that is formed of fire resistant fabric, should also be sewn together or seamed with the fire resistant sewing yarn of the present invention.

The composite yarn is treated with at least one suitable bonding agent, including but not limited to at least one member selected from the group consisting of polyurethanes, polyacrylics, nylons and other conventional fiber bonding compositions.

Referring now to FIG. 1, the sewing thread 10 of the invention is shown with a core 12, an inner cover yarn 14, and a top cover yarn 16. Core 12 is a yarn preferably made up of polyester, or nylon filaments or fibers, but most preferably it is a 150-denier flat polyurethane. While a single core strand 12 is illustrated additional strands can be used, so long as the total denier does not exceed 1,000. The inner cover 14 is most preferably fiberglass #450 (100 denier), #225 (200-denier), or #150 (300-denier). The fiberglass is wrapped around the core, preferably at about 3–5 turns per inch. For additional heat protection, one or more additional strand(s) of fiberglass may be used, in which case each additional strand is preferably wrapped in the opposite direction.

The outer cover 16 may be any non high-performance polymeric yarn, such as polyester or nylon filaments or fibers. The outer cover is preferably 150-denier polyester flat yarn, however the other deniers can be used up to about 300.

Again, the outer cover may include one or more additional wraps, each in the opposite direction from the previous. So formed, the outer cover maintains the bottom cover (preferably fiberglass) within the yarn bundle and protects the composite yarn overall.

The total denier of the composite yarn should be between 300 and 1,000-denier. The yarn 12 in the core is shown as a single strand; however there may be more than one. Further, there may be a plurality of yarns in the inner cover 14 or the outer cover 16.

Once the composite yarn is formed, it is subjected to a finishing operation in which at least one bonding agent and at least one lubricant is applied. These can be applied in any conventional manner, including but not limited to spraying on the fiber, application by kiss-roll, or dipping the yarn into a bath containing the bonding agent or lubricant, either neat or as a solution in a suitable organic or aqueous solvent. The preferred lubricant is a silicone with paraffin added. Additional lubricants which have been found to be satisfactory are—RAYOLAN 1813, Boehme FILATEX, or KL 400 (Kelmar).

For purposes of illustration, several examples are set forth below:

EXAMPLE 1

Core—polyester (flat)—150-denier
Inner cover—fiberglass #450–100-denier
Outer Cover—polyester (flat)—150-denier
Total denier—434

EXAMPLE 2

Core—polyester (flat)—150-denier
Inner cover—fiberglass # 225 200-denier
Outer cover polyester (flat)—150-denier
Total denier—531

EXAMPLE 3

Core—polyester (flat)—150-denier
Inner cover—fiberglass # 150—300-denier
Outer cover—polyester (flat)—150-denier
Total denier 631

Figure 2:
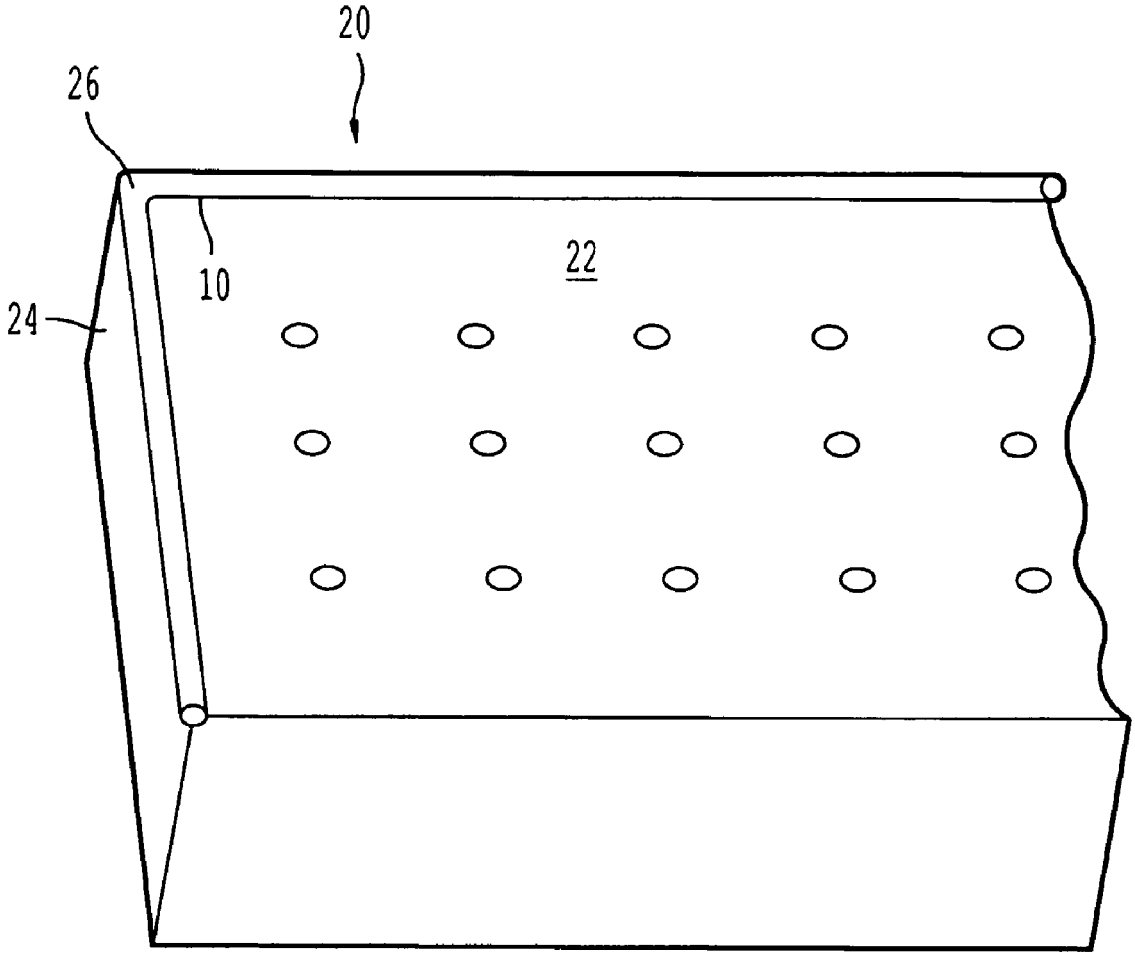
FIG. 2 is a schematic plan view of one type of article, i.e., a mattress, with the fabric covering sewn together with the sewing thread of this invention.

As illustrated in FIG. 2, the sewing thread 10 is utilized in piecing together fabric covers or ticking for such items as mattresses, pillows, quilts, and other bedding. In FIG. 2, mattress 20 includes a cover 22, sides 24, and a welt 26. The yarn 10 is used to connect the edges of cover 22, sides 24, and the welt 26. So formed, when subjected to fire or extreme heat, the fiberglass in the sewing thread 10 will not melt or burn, even though the polymeric fibers do melt and the mattress will stay intact.

While certain preferred embodiments have been described in detail here and above, it is apparent that various changes may be made without departing from the scope of the invention. For example, as stated here and above, the composite sewing thread may include multiple strands in the core, multiple strands in the inner cover, and/or multiple strands in the outer cover.

The invention claimed is:

1. A composite heat resistant sewing thread comprising:

a) a core formed of at least one strand of a yarn having an elongation of at least 3%;

b) at least one bottom cover wrapped around the core in a first direction at a rate sufficient to provide substantially complete coverage of the core by the bottom cover, wherein the bottom cover has an elongation of less than 1% and is made of a high-tenacity yarn;

c) at least one outer cover wrapped around the at least one bottom cover, wherein the outer cover is wrapped in a second direction opposite to a direction of a cover layer on which the outer cover is directly wrapped, at a rate sufficient to provide substantially complete cover of the cover layer on which the outer cover is directly wrapped;

d) at least one bonding agent applied onto the at least one outer cover; and e) a lubricant;

wherein the composite heat resistant sewing thread remains intact when subjected to temperatures exceeding 1,000° C.

2. The composite heat resistant sewing thread of claim 1, wherein said at least one bottom cover is made from fiberglass.

3. The composite heat resistant sewing thread of claim 1, wherein said core is formed of at least one strand of a yarn selected from the group consisting of nylon and polyester yarns.

4. The composite heat resistant sewing thread of claim 1, wherein said outer cover is formed of at least one strand of a yarn selected from the group consisting of nylon and polyester yarns.

5. The composite heat resistant sewing thread of claim 1, wherein:

said core is formed of at least one strand of a yarn selected from the group consisting of nylon and polyester;

said at least one inner cover strand is formed of fiberglass;

said at least one outer cover strand is formed of a yarn selected from the group consisting of nylon and polyester yarns.

6. The composite heat resistant sewing thread according to claim 2, wherein said fiberglass has a denier of from 100 to 300.

7. The composite heat resistant sewing thread according to claim 6, wherein the core has a denier of 150, and the at least one outer cover strand has a denier of 150.

8. The composite sewing thread according to claim 2 wherein the fiberglass is wrapped around the core at the rate of 3–5 turns per inch.

9. The composite sewing thread according to claim 1 wherein the composite sewing thread has a total composite denier no greater than 1000.

10. The composite sewing thread according to claim 1, wherein the lubricant is a composition comprising silicone and paraffin.

11. The composite sewing thread according to claim 10, wherein the core and at least one outer cover are each 150-denier flat polyester and the at least one bottom cover is 100-denier fiberglass.

12. The composite sewing thread according to claim 10, wherein the core and at least one outer cover are each 150-denier flat polyester and the at least one bottom cover is 200-denier fiberglass.

13. The composite sewing thread according to claim 10, wherein the core and at least one outer cover are each 150-denier flat polyester and the at least one bottom cover is 300-denier fiberglass.

14. A fire and heat resistant mattress comprising a flammable body section covered with a fire resistant cover, wherein seams of the fire resistant cover are sewed together with a composite sewing thread comprising:

a) a core formed of at least one strand of a yarn having an elongation of at least 3%;

b) at least one bottom cover wrapped around the core in a first direction at a rate sufficient to provide substantially complete coverage of the core by the bottom cover, wherein the bottom cover has an elongation of less than 1% and is made of a high-tenacity yarn;

c) at least one outer cover wrapped around the at least one bottom cover, wherein the outer cover is wrapped in a second direction opposite to a direction of a cover layer on which the outer cover is directly wrapped, at a rate sufficient to provide substantially complete cover of the cover layer on which the outer cover is directly wrapped;

d) at least one bonding agent; and e) a lubricant;

wherein the composite heat resistant sewing thread remains intact when subjected to temperatures exceeding 1,000° C.

15. The fire and heat resistant mattress of claim 14, wherein said at least one bottom cover is made from fiberglass.

16. The fire and heat resistant mattress of claim 14, wherein said core is formed of at least one strand of a yarn selected from the group consisting of nylon and polyester yarns.

17. The fire and heat resistant mattress of claim 14, wherein said outer cover is formed of at least one strand of a yarn selected from the group consisting of nylon and polyester yarns.

18. The fire and heat resistant mattress of claim 14, wherein:

said cote is formed of at least one strand of a yarn selected from the group consisting of nylon and polyester;

said at least one inner cover strand is formed of fiberglass;

said at least one outer cover strand is formed of a yarn selected from the group consisting of nylon and polyester yarns.

19. The fire and heat resistant mattress of claim 15, wherein said fiberglass has a denier of from 100 to 300.

20. The fire and heat resistant mattress of claim 19, wherein the core has a denier of 150, and the at least one outer cover strand has a denier of 150.

21. The fire and heat resistant mattress of claim 15, wherein the fiberglass is wrapped around the core at the rate of 3–5 turns per inch.

22. The fire and heat resistant mattress of claim 14, wherein the composite sewing thread has a total composite denier no greater than 1000.

23. The fire and heat resistant mattress of claim 14, wherein the lubricant is a composition comprising silicone and paraffin.

24. The fire and heat resistant mattress of claim 23, wherein the core and at least one outer cover are each 150-denier flat polyester and the at least one bottom cover is 100-denier fiberglass.

25. The fire and heat resistant mattress of claim 23, wherein the core and at least one outer cover are each 150-denier flat polyester and the at least one bottom cover is 200-denier fiberglass.

26. The fire and heat resistant mattress of claim 23, wherein the core and at least one outer cover are each 150-denier flat polyester and the at least one bottom cover is 300-denier fiberglass.

27. A pillow comprising a body portion covered by a fire resistant fabric covering with one or more seams, wherein the one or more seams are sewed together with a composite sewing thread comprising:

a) a core formed of at least one strand of a yarn having an elongation of at least 3%;

b) at least one bottom cover wrapped around the core in a first direction at a rate sufficient to provide substantially complete coverage of the core by the bottom cover, wherein the bottom cover has an elongation of less than 1% and is made of a high-tenacity yarn;

c) at least one outer cover wrapped around the at least one bottom cover, wherein the outer cover is wrapped in a second direction opposite to a direction of a cover layer on which the outer cover is directly wrapped, at a rate sufficient to provide substantially complete cover of the cover layer on which the outer cover is directly wrapped;

d) at least one bonding agent; and e) a lubricant;

wherein the composite heat resistant sewing thread remains intact when subjected to temperatures exceeding 1,000° C.

28. The pillow of claim 27, wherein said at least one bottom cover is made from fiberglass.

29. The pillow of claim 27, wherein said core is formed of at least one strand of a yarn selected from the group consisting of nylon and polyester yarns.

30. The pillow of claim 27, wherein said outer cover is formed of at least one strand of a yarn selected from the group consisting of nylon and polyester yarns.

31. The pillow of claim 27, wherein:

said core is formed of at least one strand of a yarn selected from the group consisting of nylon and polyester;

said at least one inner cover strand is formed of fiberglass;

said at least one outer cover strand is formed of a yarn selected from the group consisting of nylon and polyester yarns.

32. The pillow of claim 28, wherein said fiberglass has a denier of from 100 to 300.

33. The pillow of claim 32, wherein the core has a denier of 150, and the at least one outer cover strand has a denier of 150.

34. The pillow of claim 28, wherein the fiberglass is wrapped around the core at the rate of 3–5 turns per inch.

35. The pillow of claim 27, wherein the composite sewing thread has a total composite denier no greater than 1000.

36. The pillow of claim 27, wherein the lubricant is a composition comprising silicone and paraffin.

37. The pillow of claim 36, wherein the core and at least one outer cover are each 150-denier flat polyester and the at least one bottom cover is 100-denier fiberglass.

38. The pillow of claim 36, wherein the core and at least one outer cover are each 150-denier flat polyester and the at least one bottom cover is 200-denier fiberglass.

39. The pillow of claim 36, wherein the core and at least one outer cover are each 150-denier flat polyester and the at least one bottom cover is 300-denier fiberglass.

40. A fire resistant item of apparel comprising one or more fabric sections formed of fire resistant material and sewn along one or more seams, the seams between said fabric sections being sewed together by a composite heat resistant sewing thread comprising:

a) a core formed of at least one strand of a yarn having an elongation of at least 3%;

b) at least one bottom cover wrapped around the core in a first direction at a rate sufficient to provide substantially complete coverage of the core by the bottom cover, wherein the bottom cover has an elongation of less than 1% and is made of a high-tenacity yarn;

c) at least one outer cover wrapped around the at least one bottom cover, wherein the outer cover is wrapped in a second direction opposite to a direction of a cover layer on which the outer cover is directly wrapped, at a rate sufficient to provide substantially complete cover of the cover layer on which the outer cover is directly wrapped;

d) at least one bonding agent; and e) a lubricant;

wherein the composite heat resistant sewing thread remains intact when subjected to temperatures exceeding 1,000° C.

41. The item of apparel of claim 40, wherein said at least one bottom cover is made from fiberglass.

42. The item of apparel of claim 40, wherein said core is formed of at least one strand of a yarn selected from the group consisting of nylon and polyester yarns.

43. The item of apparel of claim 40, wherein said outer cover is formed of at least one strand of a yarn selected from the group consisting of nylon and polyester yarns.

44. The item of apparel of claim 40, wherein:

said core is formed of at least one strand of a yarn selected from the group consisting of nylon and polyester;

said at least one inner cover strand is formed of fiberglass;

said at least one outer cover strand is formed of a yarn selected from the group consisting of nylon and polyester yarns.

45. The item of apparel of claim 41, wherein said fiberglass has a denier of from 100 to 300.

46. The item of apparel of claim 45, wherein the core has a denier of 150, and the at least one outer cover strand has a denier of 150.

47. The item of apparel of claim 41, wherein the fiberglass is wrapped around the core at the rate of 3–5 turns per inch.

48. The item of apparel of claim 40, wherein the composite sewing thread has a total composite denier no greater than 1000.

49. The item of apparel of claim 40, wherein the lubricant is a composition comprising silicone and paraffin.

50. The item of apparel of claim 49, wherein the core and at least one outer cover are each 150-denier flat polyester and the at least one bottom cover is 100-denier fiberglass.

51. The item of apparel of claim 49, wherein the core and at least one outer cover are each 150-denier flat polyester and the at least one bottom cover is 200-denier fiberglass.

52. The item of apparel of claim 49, wherein the core and at least one outer cover are each 150-denier flat polyester and the at least one bottom cover is 300-denier fiberglass.

* * * * *